US012055375B2

(12) United States Patent
Parrow et al.

(10) Patent No.: US 12,055,375 B2
(45) **Date of Patent: *Aug. 6, 2024**

(54) AXIAL FLUX MACHINE FOR USE WITH PROJECTILES

(71) Applicant: Northrop Grumman Systems Corporation, Falls Church, VA (US)

(72) Inventors: Jacob M. Parrow, Chaska, MN (US); Matthew Fong, Minneapolis, MN (US); Glen Monzo, Corcoran, MN (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/097,666

(22) Filed: Jan. 17, 2023

(65) Prior Publication Data

US 2024/0110773 A1 Apr. 4, 2024

Related U.S. Application Data

(63) Continuation of application No. 17/300,443, filed on Jul. 1, 2021, now Pat. No. 11,573,069.

(Continued)

(51) Int. Cl.
*F42C 11/04* (2006.01)
*F42C 11/00* (2006.01)

(52) U.S. Cl.
CPC ..... *F42C 11/008* (2013.01)

(58) Field of Classification Search
CPC ..... F42B 10/64; F42B 10/14; F42B 10/26; F42B 15/01; F42B 10/54; F41G 7/2293; F41G 7/2253; F41G 7/222; F42C 11/008

(Continued)

(56) References Cited

U.S. PATENT DOCUMENTS 2,340,781 A 2/1944 Wagner
2,513,157 A 6/1950 Ferris et al.

(Continued)

FOREIGN PATENT DOCUMENTS

CA 2441277 10/2002
EP 0675335 10/1995

(Continued)

OTHER PUBLICATIONS

Baig et al., "Architecture for Range, Doppler and Direction Finding Radar", J. Appl. Environ. Biol. Sci., vol. 4, No. 7S, 2014, pp. 193-198.

(Continued)

*Primary Examiner* — Michael D David
(74) *Attorney, Agent, or Firm* — Christensen, Fonder, Dardi & Herbert PLLC

(57) ABSTRACT

A powered projectile having a nose portion, a body portion, a tail portion, and a central axis. In various embodiments a collar is rotatably mounted to a control support portion with a plurality of aerodynamic surfaces thereon for despinning the collar. An alternator configured as an axial flux machine with a stator arranged can be axially adjacent to one or more rotors, the stator including a plurality of windings and the one or more rotors each including a plurality of permanent magnets arranged about the face of the respective one or more rotor. In various embodiments the projectile includes an assembly of projectile control circuitry. In one or more embodiments, upon relative motion of the rotor with respect to the stator, magnetic flux from the magnets interacts with the windings of the stator and passes through an air gap between the one or more rotors and stator.

20 Claims, 11 Drawing Sheets

Related U.S. Application Data

(60) Provisional application No. 63/102,801, filed on Jul. 2, 2020.

(58) Field of Classification Search
USPC ..... 244/3.1, 3.15, 3.23, 3.21, 3.24, 3.16, 244/3.27; 102/207, 501
See application file for complete search history.

(56) References Cited

U.S. PATENT DOCUMENTS 2,687,482 A 8/1954 Harmon et al.
2,996,008 A 8/1961 Allen et al.
3,000,307 A 9/1961 Trotter, Jr.
3,111,080 A 11/1963 French et al.
3,111,088 A 11/1963 Fisk
3,233,950 A 2/1966 Baermann
3,598,022 A 8/1971 Maier
3,614,181 A 10/1971 Meeks
3,747,529 A 7/1973 Plattner
3,913,870 A 10/1975 Bolick
3,939,773 A 2/1976 Jenkins et al.
3,943,520 A 3/1976 Apstein et al.
4,044,682 A 8/1977 Karayannis
4,088,076 A 5/1978 Karayannis
4,176,814 A 12/1979 Albrektsson et al.
4,202,515 A 5/1980 Maxwell, Jr.
4,207,841 A 6/1980 Bloomer
4,267,562 A 5/1981 Raimondi
4,347,996 A 9/1982 Grosso
4,373,688 A 2/1983 Topliffe
4,379,598 A 4/1983 Goldowsky
4,431,150 A 2/1984 Epperson, Jr.
4,438,893 A 3/1984 Sands et al.
4,512,537 A 4/1985 Sebestyen et al.
4,525,514 A 6/1985 Yachigo et al.
4,528,911 A 7/1985 DePhillipo et al.
4,537,371 A 8/1985 Lawhorn et al.
4,547,837 A 10/1985 Bennett
4,565,340 A 1/1986 Bains
4,568,039 A 2/1986 Smith et al.
4,664,339 A 5/1987 Crossfield
4,665,332 A 5/1987 Meir
4,667,899 A 5/1987 Wedertz
4,715,284 A 12/1987 Hendry
4,815,682 A 3/1989 Feldmann et al.
4,860,969 A 8/1989 Muller et al.
4,898,342 A 2/1990 Kranz et al.
4,899,956 A 2/1990 King et al.
4,901,621 A 2/1990 Tidman
4,934,273 A 6/1990 Endriz
4,964,593 A 10/1990 Kranz
5,043,615 A 8/1991 Oshima
5,072,647 A 12/1991 Goldstein
5,101,728 A 4/1992 Frisk
5,125,344 A 6/1992 Kline et al.
5,126,610 A 6/1992 Fremerey
5,139,216 A 8/1992 Larkin
5,271,328 A 12/1993 Boulais et al.
5,321,329 A 6/1994 Hovorka
5,327,140 A 7/1994 Buckreub
5,381,445 A 1/1995 Hershey et al.
5,425,514 A 6/1995 Grosso
5,452,864 A 9/1995 Alford et al.
5,489,909 A 2/1996 Dittmann et al.
5,495,221 A 2/1996 Post
5,506,459 A 4/1996 Ritts
5,529,262 A 6/1996 Horwath
5,619,083 A 4/1997 Dunfield et al.
5,669,581 A 9/1997 Ringer
5,696,347 A 12/1997 Sebeny, Jr. et al.
5,725,179 A 3/1998 Gilman et al.
5,734,389 A 3/1998 Bruce et al.
5,747,907 A 5/1998 Miller
5,775,636 A 7/1998 Vig et al.
5,780,766 A 7/1998 Schröppel
5,788,178 A 8/1998 Barrett, Jr.
5,894,181 A 4/1999 Imlach
5,917,442 A 6/1999 Manoogian
5,932,836 A 8/1999 White
5,971,875 A 10/1999 Hill
5,982,319 A 11/1999 Borden et al.
5,986,373 A 11/1999 Stucker
6,020,854 A 2/2000 Jagnow et al.
6,052,647 A 4/2000 Parkinson et al.
6,126,109 A 10/2000 Barson et al.
6,135,387 A 10/2000 Seidel et al.
6,163,021 A 12/2000 Mickelson
6,186,443 B1 2/2001 Shaffer
6,204,801 B1 3/2001 Sharka et al.
6,208,936 B1 3/2001 Minor et al.
6,227,820 B1 5/2001 Jarvik
6,234,082 B1 5/2001 Cros et al.
6,314,886 B1 11/2001 Kuhnle et al.
6,345,785 B1 2/2002 Harkins et al.
6,352,218 B1 3/2002 Holmqvist et al.
6,389,974 B1 5/2002 Foster
6,390,642 B1 5/2002 Simonton
6,398,155 B1 6/2002 Hepner et al.
6,422,507 B1 7/2002 Lipeles
D461,159 S 8/2002 Miralles et al.
6,493,651 B2 12/2002 Harkins et al.
6,502,786 B2 1/2003 Rupert et al.
6,588,700 B2 7/2003 Moore et al.
6,595,041 B2 7/2003 Hansen
6,629,669 B2 10/2003 Jensen
6,653,972 B1 11/2003 Krikorian et al.
6,666,402 B2 12/2003 Rupert et al.
6,693,592 B2 2/2004 Dowdle et al.
6,727,843 B1 4/2004 Hansen
6,796,525 B2 9/2004 Johnsson et al.
6,806,605 B1 10/2004 Gabrys
6,834,591 B2 12/2004 Rawcliffe et al.
6,842,674 B2 1/2005 Solomon
6,869,044 B2 3/2005 Geswender
6,882,314 B2 4/2005 Zimmerman et al.
6,889,934 B1 5/2005 Thomas et al.
6,923,404 B1 8/2005 Liu et al.
6,970,128 B1 11/2005 Dwelly et al.
6,981,672 B2 1/2006 Clancy et al.
7,015,855 B1 3/2006 Medl et al.
7,020,501 B1 3/2006 Elliott et al.
7,098,841 B2 8/2006 Hager et al.
7,174,835 B1 2/2007 Knapp
7,226,016 B2 6/2007 Johnsson et al.
7,267,298 B2 9/2007 Leininger
7,305,467 B2 12/2007 Kaiser et al.
7,338,009 B1 3/2008 Bobinchak et al.
7,341,221 B1 3/2008 Wilson
7,354,017 B2 4/2008 Morris et al.
7,412,930 B2 8/2008 Smith et al.
7,422,175 B1 9/2008 Bobinchak et al.
7,431,237 B1 10/2008 Mock et al.
7,475,846 B2 1/2009 Schroeder
7,500,636 B2 3/2009 Bredy
7,548,202 B1 6/2009 Jennings
7,566,027 B1 7/2009 Johnson et al.
7,584,922 B2 9/2009 Bär et al.
7,626,544 B2 12/2009 Smith et al.
7,631,833 B1 12/2009 Ghaleb et al.
7,675,012 B1 3/2010 Bobinchak et al.
7,681,504 B2 3/2010 Machina et al.
7,701,380 B2 4/2010 Altes
7,781,709 B1 8/2010 Jones et al.
7,791,007 B2 9/2010 Harnoy
7,834,301 B2 11/2010 Clingman
7,849,797 B2 12/2010 Geswender et al.
7,849,800 B2 12/2010 Hinsdale et al.
7,900,619 B1 3/2011 Palmer et al.
7,947,936 B1 5/2011 Bobinchak et al.
7,963,442 B2 6/2011 Jenkins et al.
7,989,742 B2 8/2011 Bredy
7,999,212 B1 8/2011 Thiesen et al.
8,063,347 B1 11/2011 Urbano et al.
8,076,623 B2 12/2011 Dryer

(56) References Cited

U.S. PATENT DOCUMENTS

| | | | |
|---|---|---|---|
| 8,113,118 | B2 | 2/2012 | Schmidt et al. |
| 8,125,198 | B2 | 2/2012 | Steinbrecher |
| 8,183,746 | B2 | 5/2012 | Rastegar |
| 8,229,163 | B2 | 7/2012 | Coleman et al. |
| 8,258,999 | B2 | 9/2012 | Rastegar et al. |
| 8,288,698 | B2 | 10/2012 | Seidensticker |
| 8,288,699 | B2 | 10/2012 | Romero et al. |
| 8,319,162 | B2 | 11/2012 | Mccool |
| 8,319,163 | B2 | 11/2012 | Flood et al. |
| 8,319,164 | B2 | 11/2012 | Martinez |
| 8,324,542 | B2 | 12/2012 | Frey, Jr. |
| 8,344,303 | B2 | 1/2013 | Elgersma et al. |
| 8,410,412 | B2 | 4/2013 | Geswender et al. |
| 8,426,788 | B2 | 4/2013 | Geswender |
| 8,471,186 | B2 | 6/2013 | Wallis |
| 8,471,758 | B2 | 6/2013 | Samuel et al. |
| 8,487,226 | B2 | 7/2013 | Biswell |
| 8,508,404 | B1 | 8/2013 | Wilmhoff |
| 8,519,313 | B2 | 8/2013 | Geswender et al. |
| 8,552,349 | B1 | 10/2013 | Alexander |
| 8,552,351 | B2 | 10/2013 | Geswender et al. |
| 8,558,151 | B2 | 10/2013 | Seidensticker |
| 8,669,505 | B2 | 3/2014 | Guibout et al. |
| 8,674,277 | B2 | 3/2014 | Axford et al. |
| 8,698,059 | B2 | 4/2014 | Nikkel et al. |
| 8,701,558 | B2 | 4/2014 | Rastegar et al. |
| 8,716,639 | B2 | 5/2014 | Mallon |
| 8,748,787 | B2 | 6/2014 | Weiss et al. |
| 8,757,064 | B2 | 6/2014 | Jennings et al. |
| 8,812,654 | B2 | 8/2014 | Gelvin et al. |
| 8,816,260 | B2 | 8/2014 | Hindman et al. |
| 8,832,244 | B2 | 9/2014 | Gelvin et al. |
| 8,836,503 | B2 | 9/2014 | Gelvin et al. |
| 8,916,810 | B2 | 12/2014 | Geswender et al. |
| 8,950,335 | B2 | 2/2015 | Strömberg et al. |
| 8,993,948 | B2 | 3/2015 | Geswender et al. |
| D729,896 | S | 5/2015 | Martinez |
| 9,031,725 | B1 | 5/2015 | DiEsposti |
| 9,040,885 | B2 | 5/2015 | Morris et al. |
| 9,048,701 | B2 | 6/2015 | Lang |
| 9,052,202 | B2 | 6/2015 | Riley |
| 9,070,236 | B1 | 6/2015 | DiEsposti |
| 9,071,171 | B2 | 6/2015 | Rastegar et al. |
| 9,086,258 | B1 | 7/2015 | Vasudevan et al. |
| 9,108,713 | B2 | 8/2015 | Tao et al. |
| 9,187,184 | B2 | 11/2015 | Miralles et al. |
| 9,194,675 | B1 | 11/2015 | Manole et al. |
| 9,211,947 | B2 | 12/2015 | Miralles |
| 9,303,964 | B2 | 4/2016 | Wurzel et al. |
| 9,347,753 | B1 | 5/2016 | Horch et al. |
| 9,360,286 | B2 | 6/2016 | Pettersson et al. |
| 9,371,856 | B2 | 6/2016 | Kundel |
| 9,557,405 | B2 | 1/2017 | Takahashi et al. |
| 9,587,923 | B2 | 3/2017 | Wurzel et al. |
| 9,644,929 | B1 | 5/2017 | Bradbury et al. |
| 9,683,814 | B2 | 6/2017 | Dryer |
| 9,709,372 | B2 | 7/2017 | Edwards |
| 9,939,238 | B1 | 4/2018 | Sowle et al. |
| 10,054,404 | B2 | 8/2018 | Balk et al. |
| 10,203,188 | B1 | 2/2019 | Sowle et al. |
| 10,288,397 | B2 | 5/2019 | Rastegar et al. |
| 11,031,885 | B1 | 6/2021 | Yavid |
| 11,056,962 | B2 | 7/2021 | Kao |
| 11,573,069 | B1 | 2/2023 | Parrow et al. |
| 2001/0030260 | A1 | 10/2001 | Niemeyer et al. |
| 2003/0076260 | A1 | 4/2003 | Ryken et al. |
| 2004/0046467 | A1 | 3/2004 | Huang et al. |
| 2004/0068415 | A1 | 4/2004 | Solomon |
| 2004/0099173 | A1 | 5/2004 | Rector et al. |
| 2004/0134337 | A1 | 7/2004 | Solomon |
| 2005/0034627 | A1 | 2/2005 | Manole et al. |
| 2005/0061191 | A1 | 3/2005 | Dietrich et al. |
| 2006/0061949 | A1 | 3/2006 | Chen et al. |
| 2008/0012751 | A1 | 1/2008 | Owens et al. |
| 2008/0061188 | A1 | 3/2008 | Morris et al. |
| 2008/0093498 | A1 | 4/2008 | Leal et al. |
| 2008/0115686 | A1 | 5/2008 | Crist et al. |
| 2008/0223977 | A1 | 9/2008 | Dryer |
| 2008/0237391 | A1 | 10/2008 | Mock et al. |
| 2010/0199873 | A1 | 8/2010 | Rastegar |
| 2010/0213307 | A1 | 8/2010 | Hinsdale et al. |
| 2010/0237185 | A1 | 9/2010 | Dryer |
| 2010/0285721 | A1 | 11/2010 | Ma |
| 2011/0032361 | A1 | 2/2011 | Tamir |
| 2011/0094372 | A1 | 4/2011 | Carlson |
| 2012/0068000 | A1 | 3/2012 | Goldner et al. |
| 2012/0211593 | A1 | 8/2012 | Morris et al. |
| 2012/0255426 | A1 | 10/2012 | Reynard et al. |
| 2013/0126612 | A1 | 5/2013 | Durkee |
| 2013/0126667 | A1 | 5/2013 | Weiss et al. |
| 2013/0126668 | A1 | 5/2013 | Chessel et al. |
| 2015/0203201 | A1 | 7/2015 | Tao et al. |
| 2015/0330755 | A1 | 11/2015 | Citro et al. |
| 2016/0185445 | A1 | 6/2016 | Miralles et al. |
| 2016/0252333 | A1 | 9/2016 | Carlqvist et al. |
| 2016/0347476 | A1 | 12/2016 | Andryukov |
| 2017/0021945 | A1 | 1/2017 | Fisher et al. |
| 2017/0023057 | A1 | 1/2017 | Li et al. |
| 2017/0191809 | A1 | 7/2017 | Harris et al. |
| 2017/0299355 | A1 | 10/2017 | Trouillot et al. |
| 2018/0245895 | A1 | 8/2018 | Malul et al. |
| 2019/0041175 | A1 | 2/2019 | Fellows et al. |
| 2019/0041527 | A1 | 2/2019 | Gutafson |
| 2019/0323376 | A1 | 10/2019 | Virkler et al. |
| 2020/0064112 | A1 | 2/2020 | Raml |
| 2020/0292287 | A1 | 9/2020 | Thoren et al. |

FOREIGN PATENT DOCUMENTS

| | | |
|---|---|---|
| EP | 2165152 | 8/2014 |
| GB | 2547425 | 8/2017 |
| WO | WO2007058573 | 5/2007 |

OTHER PUBLICATIONS

Bekmezci et al, "Flying Ad-Hoc Networks (FANETs): A Survey", posted on the Internet at elsevier.com/locate.adhoc; Jan. 8, 2013, published by Elsevier, Amsterdam, The Netherlands; 17 pages.

Costanzo et al., "High Resolution Software Defined Radar System for Target Detection", Journal of Electrical and Computer Engineering, vol. 2013, Article ID 573217, 2013, 8 pages.

Kwag et al., "Modern Software Defined Radar (SDR) Technology and Its Trends", Journal of Electromagnetic Engineering and Science, vol. 14, No. 4, Dec. 2014, pp. 321-328.

Zhang, B. et al. Mechanical Construction and Analysis of an Axial Flux Segmented Armature Torus Machine, International Conference on Electrical Machines, Sep. 2-5, 2014, pp. 1293-1299.

Zou, T. et al., "Analysis of a Dual-Rotor, Toroidal-Winding, Axial-Flux Vernier Permanent Magnet Machine", Institute of Electrical and Electronics Engineers, May/Jun. 2017, vol. 53, No. 3, pp. 1920-1930.

AXIAL FLUX MACHINE FOR USE WITH PROJECTILES

RELATED APPLICATIONS

The present application is a continuation of U.S. patent application Ser. No. 17/300,443, filed Jul. 1, 2021, which claims the benefit of U.S. Provisional Patent Application No. 63/102,801, filed Jul. 2, 2020, the contents of which are hereby incorporated by reference in their entireties.

FIELD OF THE DISCLOSURE

The present disclosure relates to supplying power to projectile components. Specifically, various embodiments relate to axial flux alternators for use in a projectile.

BACKGROUND

Extensive efforts have been directed toward guiding, steering, or configuring military grade projectiles for proximity sensing, seeking, or other "smart" operations. Such projectiles greatly enhance target engagement and operational efficiencies compared to traditional projectiles. For example, in certain applications the ability to perform guided maneuvers and/or the ability to perform proximity sensing may be necessary to provide a reasonable probability of engaging a target as delivery errors, environmental factors, or other issues are known to significantly degrade the effectiveness of traditional projectiles. This is particularly true when engaging moving targets, small targets, or targets that can take evasive action. In addition, such capabilities can reduce collateral damage, conserve ammunition, reduce costs, minimize personnel time in engaging targets, among other benefits.

Such projectiles have included barrel-fired and non-barrel-fired projectiles, boosted, and non-boosted projectiles, and spin stabilized and fin-stabilized projectiles. In addition, such projectiles have included, low caliber (50 caliber or less), medium caliber (greater than 50 caliber to 75 mm), and large caliber projectiles (greater than 75 mm and generally used as artillery, rockets, and missiles).

For example, large caliber artillery and other projectiles, have been successfully guided—utilizing systems such as shown in U.S. Pat. No. 6,981,672, owned by the owner of the instant application. Artillery shells utilizing this type of design have been well received by the military. For example, see U.S. Pat. No. 7,412,930. These patents are incorporated herein by reference in their entirety for all purposes.

Guided missiles have long been utilized for targeting aircraft and may be self-guided or remotely guided. See, for example: U.S. Pat. No. 3,111,080, incorporated herein by reference in its entirety for all purposes. Such missiles are typically fin-stabilized rather than spin-stabilized, having internal propulsion systems and relying upon fins and radially extending flaps or propulsion directing members for altering flight path. In addition, guided missiles typically need to be launched or fired from launch tubes or brackets that are designed specific to the missile. Due to their internal propulsion systems, missiles are substantially more expensive than non-propelled projectiles.

With respect to medium and small caliber projectiles, several solutions have been proposed utilizing movable aerodynamic surfaces for steering. For example, U.S. Pat. No. 6,422,507, incorporated herein by reference in its entirety for all purposes, discloses a greater than 50 caliber projectile that may be fired from a conventional barreled gun. This projectile utilizes a spoiler that extends and retracts from a rearwardly positioned despun portion out into the air stream. The despun portion is despun by a motor and batteries are disclosed as providing power to the bullet.

Several solutions to guiding small caliber projectiles, that is 50 caliber or less, have been proposed. These include firing the projectile without spinning the projectile and utilizing axially extending control fins for altering the flight. See, for example, U.S. Pat. No. 7,781,709, incorporated herein by reference in its entirety for all purposes. A notable disadvantage to such projectiles is that they cannot be fired from existing rifled barrels for conventional non-steerable projectiles and require internal batteries for operating the control circuitry and control fins which may affect the useful life of the projectile and provides a failure path. U.S. Pat. No. 5,788,178, incorporated herein by reference in its entirety for all purposes, also discloses a small caliber bullet that is designed to be fired from a non-rifled barrel. Deployable flaps are utilized controlling the flight path in the '178 device and the device requires a battery.

U.S. Pat. No. 8,716,639 discloses small to medium caliber projectiles fired through a rifled barrel that use beveled surfaces or canards on a despun nose portion operated by a motor and battery for flight control. U.S. Pat. No. 4,537,371 discloses a projectile fired through a barreled projectile that distributes air from the air stream through the projectile with valves to discharge the air laterally to change the flight path. These references are incorporated herein by reference in their entirety for all purposes.

Additional prior guidance systems utilizing fins, wing-like projections, or canards have been proposed. See for example the following U.S. patents: U.S. Pat. Nos. 4,004,519; 4,373,688; 4,438,893; 4,512,537; 4,568,039; 5,101,728; 5,425,514; 6,314,886; 6,502,786; 7,431,237; 7,849,800; 8,319,164; 8,552,349; 9,303,964; 10,038,349. These patents are incorporated herein by reference in their entirety for all purposes.

It is generally understood in the art that fuzing, sensing, proximity, and other "smart" functions are generally required for such projectiles. Further, for all types and sizes of such projectiles, elements necessarily include some form of powered control/operation circuitry and a power supply. Control/operation circuitry generally includes electrically powered circuitry such as a processor, memory, communications circuitry, sensors, fuzing, and other componentry. Furthermore, such componentry generally needs to be activated extremely quickly once the projectile is fired, as the flight time will generally be short. For example, for small and medium caliber projectiles, that timeframe may be within a few seconds to milliseconds.

For example, U.S. Pat. Nos. 4,568,039, 9,303,964, 4,438,893, 8,552,349; 5,101,728, incorporated above, among others, include a discussion of a projectile with a radial flux machine or otherwise generically described alternator that is configured to produce power for the projectile while the projectile is in flight. As such, further improvements would be welcome for such projectiles that allow miniaturization, provide cost savings, improve performance, of projectiles with on-board power supplies.

SUMMARY

One or more embodiments of the present disclosure are directed to a powered projectile. In one or more embodiments the powered projectile includes a main body portion, a tail portion, and a nose portion. In various embodiments the projectile includes a spinning or despinning power generation element that is rotatably mounted to the projectile and includes one or more aerodynamic features for spinning or despinning the element about a projectile axis, with respect to a remainder of the projectile during projectile flight. In such embodiments the spinning motion of the power generation element is configured to generate electricity within the projectile using an alternator included within the projectile. For example, during projectile flight the spinning motion of the power generation is translated to rotate one or more rotor components of the alternator, relative to a stator, to create an electrical current for powering various circuitry or other components within the projectile.

In various embodiments the alternator is an axial flux machine including a stator arranged axially adjacent to one or more rotors. In one or more embodiments the stator includes a plurality of windings and the one or more rotors each include a plurality of permanent magnets arranged about the face of the respective one or more rotors. In one or more embodiments, upon relative motion of the rotor with respect to the stator, magnetic flux from the magnets interacts with the windings of a stator and passes through the air gap between the one or more rotors and stator. In embodiments where two or more rotors are present, the stator is axially arranged between the two rotors. In such embodiments the flux is generated at a magnet on the one or more rotors and passes axially through the first stator tooth and immediately arrives at a second magnet at the other rotor.

Furthermore, in various embodiments the alternator is a modular axial flux machine where the alternator comprises at least a primary alternator module and one or more additional or auxiliary modules axially arranged with the primary alternator module. In such embodiments, the alternator modules are cascaded, stacked, or otherwise arranged axially with one another along the projectile axis.

In such embodiments the primary module includes a first stator having a first plurality of windings that are arranged axially adjacent to a first rotor with a first plurality of permanent magnets. In various embodiments the auxiliary module includes a second stator having a second plurality of windings that are arranged axially adjacent to a second rotor having a second plurality of plurality of permanent magnets arranged about the face of the second rotor. In such embodiments, the modules are arranged such that rotor and stator windings of each respective module face one another to form alternating layer of stator windings and rotor magnets. As a result, in various embodiments the cascaded modules can be utilized to produce greater power outputs than a typical alternators such as a radial flux alternator.

As used herein, while the term "rotor" typically indicates that the element is configured to rotate with respect to a stator, in some embodiments only some of the rotors could be configured to rotate while other rotors could remain stationary within the cascaded stack of alternator modules. In such a manner the term "rotor" is used to the elements that hold a plurality of magnets and that, in some instances, can be configured to also rotate about the projectile axis relative to the one or more stators. As used herein, the terms "despun", "despin", "despinning", or other variant of the term, refers to an object that is spun in a direction about its longitudinal axis that, in some instances, is counter-rotational with another portion of the projectile. However, the terms also include objects that are the only spun or spinning portion of the projectile. For example, in some instances a despun collar refers to a collar that is spinning about its longitudinal axis while a remainder of the projectile has a 0 Hz rotational motion, relative to the earth. As such, the terms "despun" and "spun" or variant of either of these terms can be used interchangeably herein.

Traditionally, projectile alternators have utilized radial flux machines for power generation. In such machines a radially external rotor, typically including a plurality of permanent magnets positioned on the inside surface of the rotor, spins about an inner stator, typically including windings. In such designs the projectile outer diameter and the stator inner diameter pose a hard constraint for the projectile and present significant design limitations. Furthermore, the projectile's outer diameter is limited by the internal diameter of the gun barrel. As a result, traditional radial flux alternators cannot easily be increased, for example to expand projectile power generation capability. Furthermore, because electronic circuitry will often occupy an interior cavity created within the stator, the interior diameter of the stator limits the electronics and vice versa. Because of these constraints this alternator design is highly limited. In addition, such designs will generally require more expensive design compensation to achieve voltage/torque performance requirements, for example, by requiring more expensive lamination material to reduce the saturation caused by the magnetic flux density.

In contrast, various embodiments of the disclosure provide benefits in the form of a modular alternator system that is not limited by the outer diameter of the projectile to scale up or down the power generation capacity of the power supply system. For example, various embodiments can be easily scaled up or down by cascading multiple modules along the projectile axis to meet power requirements of internal components. Further, various embodiments provide a higher voltage per volume density, which may reduce the cost of the alternator for a chosen system, whether the cost is in dollar value, or in space saved in the projectile.

In addition, one or more embodiments provide benefits in the form of a powered projectile that removes the requirement for internal batteries. For example, known powered projectiles often utilize batteries or data-hold batteries to assist in quickly powering on. However, such batteries typically require that the projectile be deployed relatively soon after installation or, in the case of data-hold batteries, once the mission data has been received in local memory. For example, such batteries generally do not allow for efficient recharging and, in some combat situations, the batteries may be required to hold mission data and/or power various internal circuitry for several days on a single charge. If the projectile is not deployed within a certain timeframe, the battery may have to be replaced. Such batteries are generally an expensive component and the potential for battery replacement only magnifies that disadvantage. In addition, certain batteries may pose hazard risks. For example, a chemically ignited battery may require the combining and/or mixing of typically hazardous chemicals.

Various embodiments of the disclosure provide benefits in the form of a versatile modular powered platform for a projectile. In such embodiments, components of the projectile, including the nose portion access, payload and/or various control circuitry can be quickly accessed and configured by a user to quickly configure the projectile for a variety of functions. In addition, in various embodiments the projectile can include one or more standardized connectors for quickly connecting/disconnecting electrical components with the interior power generator.

In one or more embodiments, the despinning or spinning power generation element is a collar assembly. In such embodiments, the powered projectile includes a control support portion that supports the collar assembly. In various embodiments the collar assembly includes a collar that is rotatably mounted on the control support portion and includes one or more aerodynamic features for despinning the collar with respect to a remainder of the projectile during projectile flight. In such embodiments the despinning motion of the collar translates the rotational energy to rotate the rotor to generate electricity using the alternator. In one or more embodiments, the despinning or spinning power generation element is a fuzing module rotatably attached to the forward nose of the projectile. In such embodiments, the despinning motion of the fuzing module the collar translates the rotational energy to rotate the rotor to generate electricity using the alternator.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, explain the principles of the disclosure. The drawings are only illustrative of certain embodiments and do not limit the disclosure.

Figure 1:
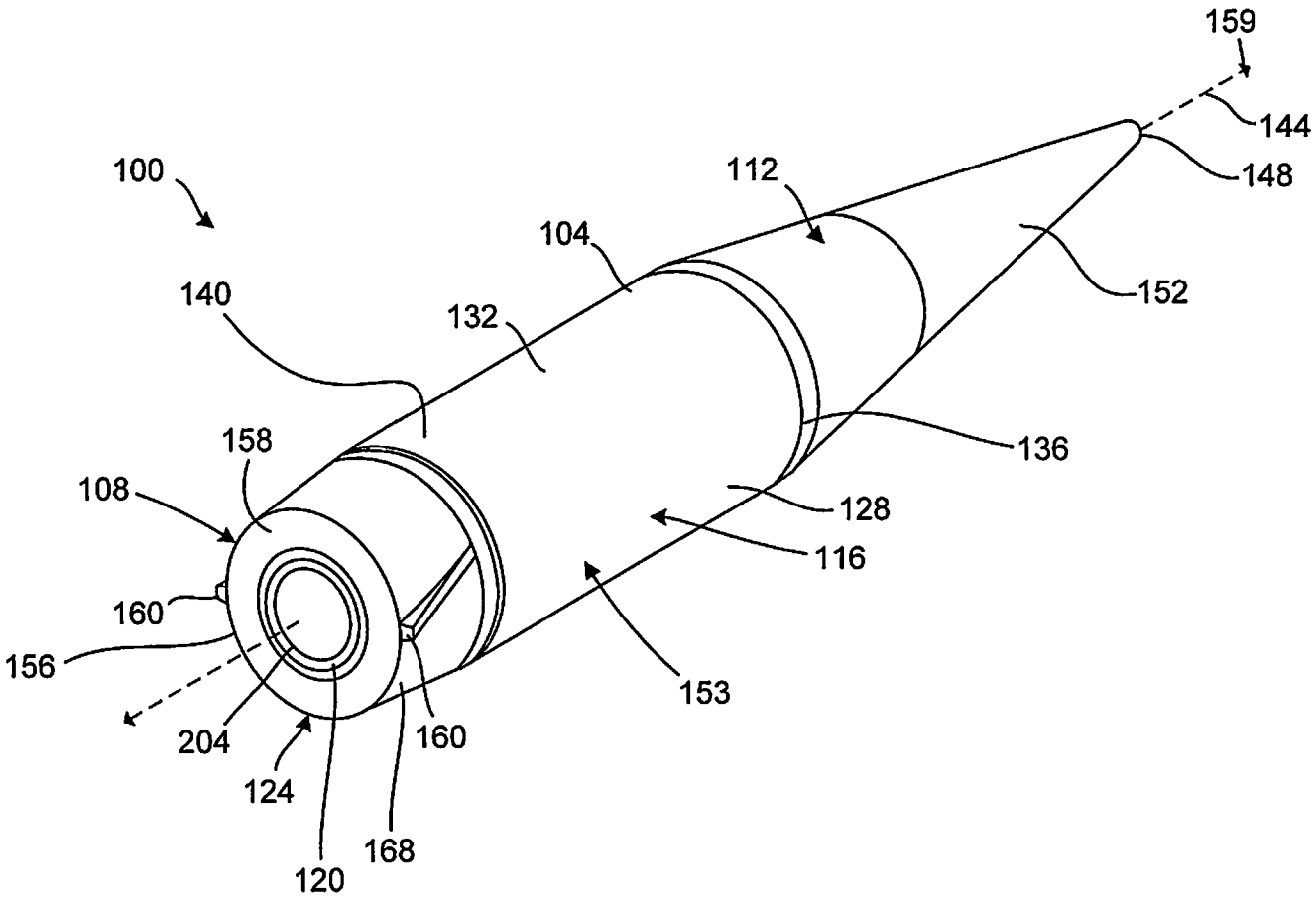
FIG. 1 depicts a rear perspective view of a powered projectile, according to one or more embodiments of the disclosure.

While the embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
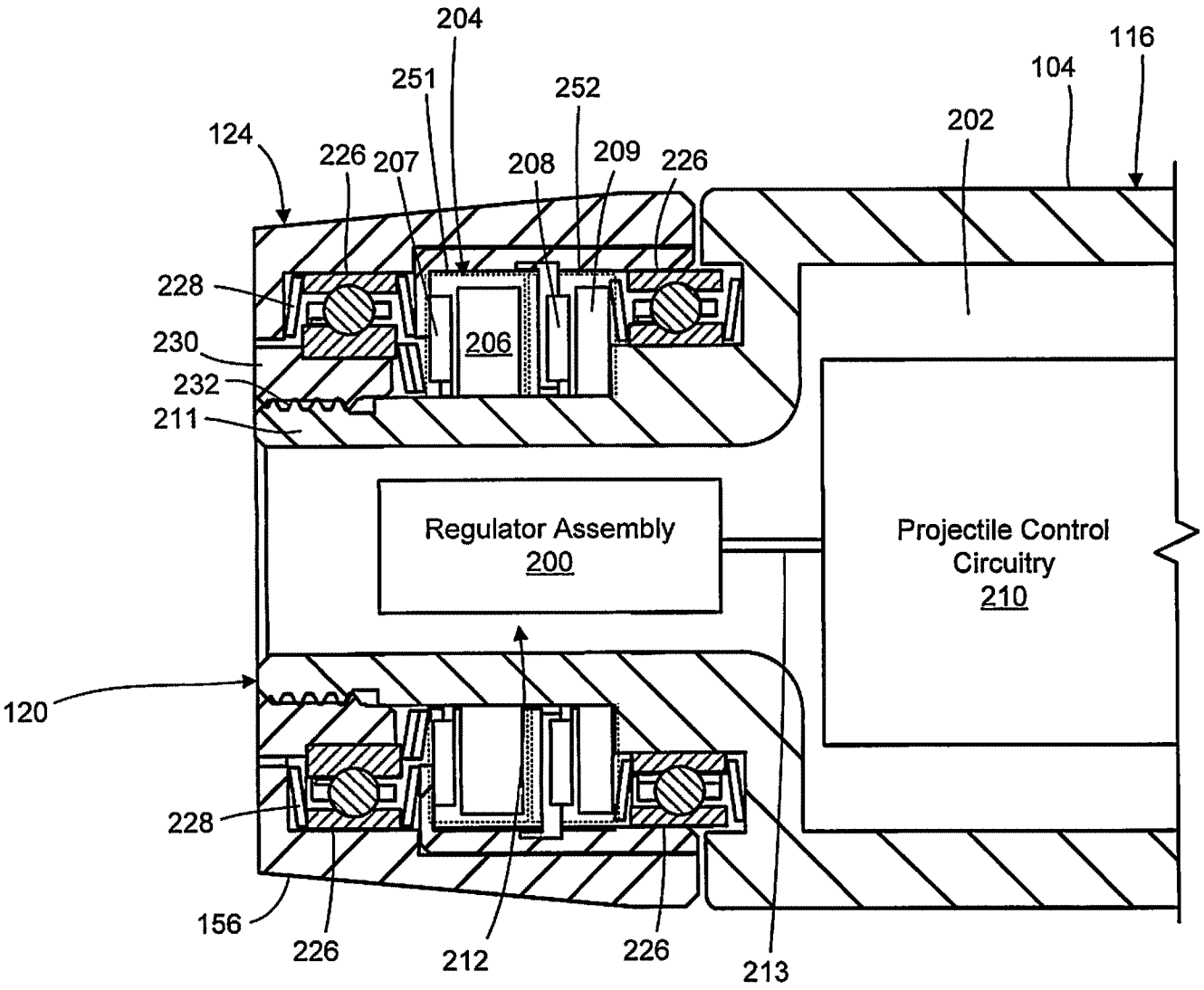
FIG. 2 depicts a cross-sectional view of the projectile, according to one or more embodiments of the disclosure.

FIGS. 1-2 depict a rear perspective view of a projectile 100 and a cross-sectional view of the projectile 100, according to one or more embodiments of the disclosure. In various embodiments, the projectile 100 includes a main body portion 104, a tail portion 108, and a nose portion 112. A chassis 116 extends from the nose portion 112, defines the main body portion 104, and extends to the tail portion 108. The chassis 116 is, in some embodiments, machined or formed from a single block of metal. In one or more embodiments, the chassis 116 defines, at the tail portion 108, a control support portion 120 that supports a collar assembly 124. In various embodiments the collar assembly 124 includes a collar 156 that is rotatably mounted on the control support portion 120 and includes one or more aerodynamic features for despinning the collar 156 with respect to a remainder of the projectile 100 during projectile flight.

Described further below, in such embodiments the despinning motion of the collar 156 translates the rotational motion of the collar to cause a corresponding rotational motion of one or more alternator components in the projectile to generate electricity via the relative motion of magnets and windings in an alternator 204 disposed in the collar assembly 124, described further below. Power generated by the alternator 204 is utilized for powering various projectile control circuitry 210 or other components within the projectile 100.

In one or more embodiments, the projectile 100 additionally includes a regulator assembly 200. Described further below, the regulator assembly 200 is a collection of power control components included in the projectile 100 for regulating the input power received from the alternator 204. In such embodiments, the components of the regulator assembly 200 include devices configured to produce a regulated output/downstream voltage such that projectile control circuitry 210 connected to the regulator assembly 200 receives a voltage which does not exceed a voltage suitable for operation, regardless of the input voltage produced by the alternator 204.

In one or more embodiments, the main body portion 104 provides a structure for containing and/or supporting various elements of the projectile 100 including payload and operational components. For example, in certain embodiments, communication componentry, sensing components, processing components, or other components of the projectile 100 may be located within one or more cavities formed within the main body portion 104. For example, in various embodiments the main body portion 104 includes projectile control circuitry 210 included within a cavity 202. Described additionally below with reference to FIG. 3, projectile control circuitry 210 generally includes processing, memory and other components of the projectile 100.

In certain embodiments, the main body portion 104 has a cylindrical shape or a generally cylindrical shape defined by a main body sidewall 128. In various embodiments, the main body portion 104 has an exterior surface 132, a forward portion 136 and a rearward portion 140. In some embodiments, the main body sidewall 128 includes one or more tapered portions that converge in a direction along a central axis 144. For example, in some embodiments a first portion, such as the forward portion 136, converges in a forward direction, along central axis 144, towards the nose portion 112. In some embodiments, a second portion, such as the rearward portion 140 could converge in a rearward direction towards the tail portion 108.

The nose portion 112 is a forward facing (e.g. in the first direction 159) structure and has a tapered or a converging shape. As such, the nose portion 112 extends from the forward portion 136 of the main body portion 104, forwardly, in a first direction, along central axis 144 to a forward tip portion 148. In various embodiments, nose portion 112 has an exterior surface 152 and may be conical or have a curved taper from the forward portion 136 of the main body portion 104 to the forward tip portion 148.

In one or more embodiments the chassis 116 defines, at the tail portion 108, the control support portion 120. In various embodiments, the tail portion 108 includes the collar assembly 124, which is mounted on and around the control support portion 120. In various embodiments the control support portion 120 is a structure for supporting various components of the projectile 100. For example, in one or more embodiments the control support portion 120 includes an axially projecting central stub portion 211 for supporting the collar assembly 124 and other elements of the projectile 100. In certain embodiments, the control support portion 120 is unitary or integral with the chassis 116, while in some embodiments, the control support portion 120 is separable from the chassis 116.

In one or more embodiments the central stub portion 211 defines a cavity 212 within the control support portion 120 for supporting one or more components of the projectile 100. In various embodiments, the regulator assembly 200 is disposed within the cavity 212 of the control support portion 120 and bridges an electrical connection 213 between the alternator 204 of the projectile 100 and the projectile control circuitry 210. While projectile control circuitry 210 is depicted in FIG. 2 as positioned in cavity 202 of the main body portion 104, in certain embodiments various control circuitry such as communication componentry, sensing components, processing components, or other components of the projectile 100 may be located partially or entirely within the control support portion 120, for example, within the cavity 212.

In one or more embodiments, the components of the collar assembly 124 include the collar 156, alternator 204, bearings 226, support springs 228, and a nut configured as an end cap 230 that attaches to a threaded portion 232 of the control support portion 120 to secure the collar assembly 124 in place.

In one or more embodiments, the collar 156 of the collar assembly 124 includes a plurality of aerodynamic control surfaces and structures disposed on an external wall. For example, as seen in FIG. 1, collar 156 includes a plurality of strakes 160. In various embodiments strakes 160 wrap around and extend axially from an exterior surface 168 of the collar 156 in a spiral or angled arrangement. In such embodiments, the strakes 160 are configured to despin the collar 156 of the collar assembly 124 when the projectile is traveling through the air from the interaction of oncoming air with the strakes 160 of the collar assembly. While FIG. 1 depicts a configuration of the collar 156 that includes two strakes 160, in various embodiments additional or fewer strakes may be included on the collar 156. For example, in certain embodiments the collar includes six strakes 160 arranged circumferentially about the exterior of the collar 156.

In certain embodiments, the collar 156 can additionally include a flap. In such embodiments, the flap is a section of sidewall raised with respect to the exterior surface 168 of the collar 156 for generating a moment or force on the projectile 100 for selectively altering the trajectory of the projectile 100 during flight. As a consequence of the ability to control the in-flight trajectory, in various embodiments, the collar assembly 124 can extend the effective range of the projectile 100 by using the collar assembly 124 to compensate for various environmental/in-flight factors that influence the projectile off its originally aimed path and to otherwise steer the projectile to its target. In such embodiments, the collar assembly 124 can dramatically extend the effective range of the projectile compared to that of other projectiles. In addition, in various embodiments the ability to control the in-flight trajectory of the projectile 100 improves projectile accuracy by using the collar assembly 124 to compensate for moving targets, to compensate for aiming errors, or for other scenarios that would normally result in a projectile miss.

In one or more embodiments, all the aerodynamic control surfaces are contained within the axial envelope of the projectile 100 provided by the main body 104. As such, in various embodiments the aerodynamic control surfaces provide minimal drag while still functioning for despin of the collar 156. For example, in certain embodiments, the collar 156 has a boat tail or tapered shape where the collar 156 tapers rearwardly and the aerodynamic control surfaces, such as the strakes 160, are defined by the recessed or tapered exterior sidewall of the collar 156. Put another way, in certain embodiments all the aerodynamic control surfaces are defined by recesses in the collar 156 whereby the outwardly most extending aerodynamic surfaces do not extend radially outward beyond a rearward continuation of the projectile 100 envelope. Further, in certain embodiments, the rotating collar 156 and associated support components are the only movable components of the projectile 100, and all movable components of the projectile 100 are maintained within the axial envelope of the main body portion 104, thus minimizing drag.

Figure 6:
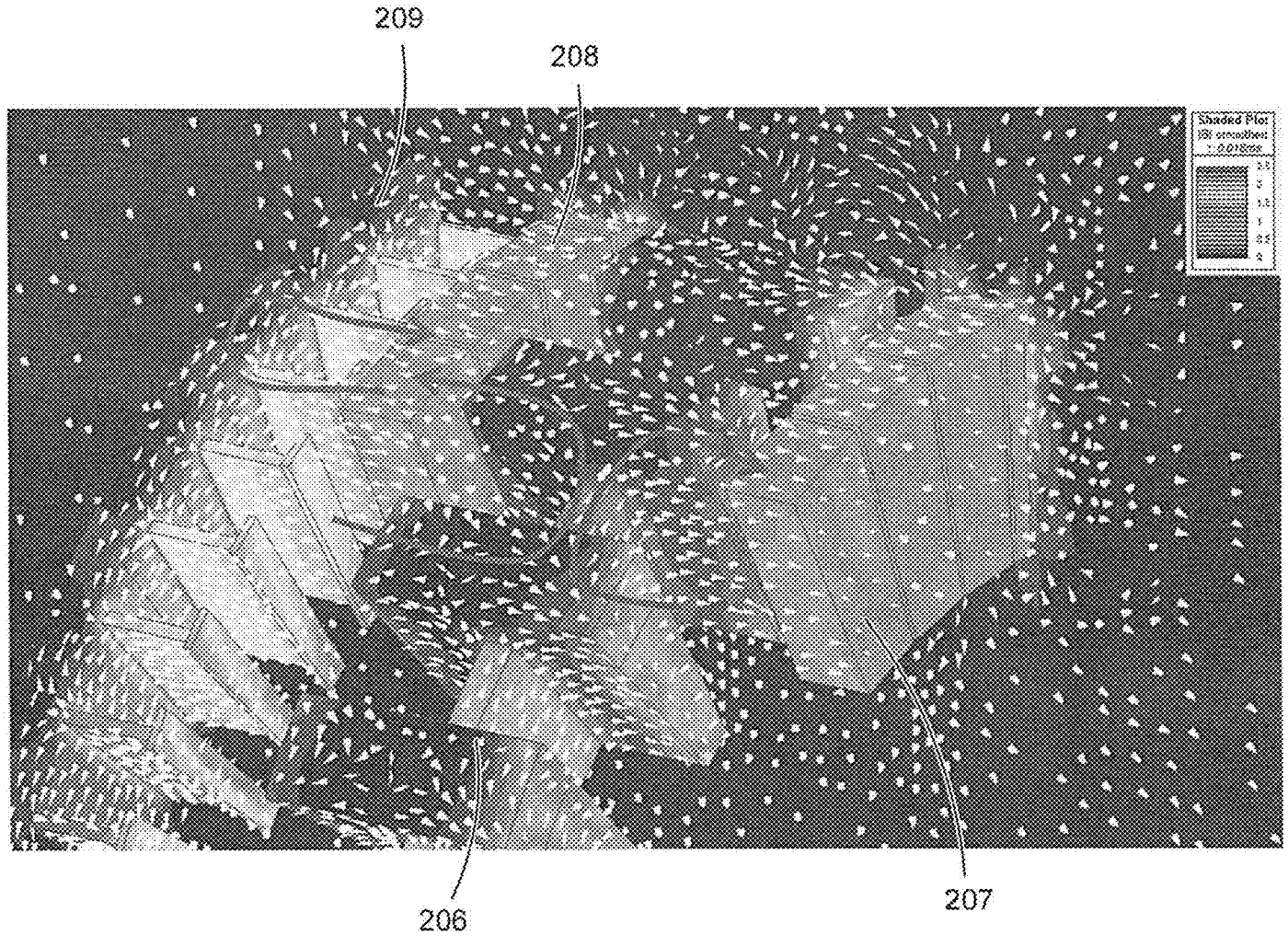
FIG. 6 depicts a magnetic flux diagram is depicted of the configuration depicted in FIG. 2 FIGS. 7-8 depict a large caliber projectile and fuzing portion for a large caliber projectile, according to one or more embodiments of the disclosure.

In various embodiments the alternator 204 is an axial flux machine. Depicted in FIG. 2 the alternator 204 includes annular power generation components 206, 207, 208, 209 comprising a primary stator 206 arranged axially between a pair of rotors 207, 208 and a secondary stator 209 positioned on another side of one of the rotors 207, 208. The power-generation components 206, 207, 208, 209 of the alternator 204 are annular components that are disposed around the control support portion 120, and oriented substantially perpendicular to central axis 144. In one or more embodiments the stators 206, 209 each include a yoke structure that support a plurality of windings while the rotors 207, 208 each include a yoke structure supporting a plurality of permanent magnets arranged circumferentially about the face of the respective rotor. In one or more embodiments, upon relative motion of the rotor, magnetic flux from the magnets interacts with the windings of a stator and passes through the air gap between the one or more rotors and stator. In embodiments where two or more rotors are present, the primary stator is axially arranged between the two rotors, such as depicted in FIG. 2. Referring to FIG. 6, a magnetic flux diagram is depicted of the configuration depicted in FIG. 2. In such embodiments the flux is generated at a magnet on the one or more rotors 207, 208 and passes axially through the first stator tooth and then bends at the core of the stator 206, 209 and travels back around the rotation axis In one or more embodiments, portions of the collar assembly 124 are independently rotatable for despinning with respect to a remainder of the projectile 100. For example, in various embodiments, the despun portions of the collar assembly 124 at least include the collar 156 and at least one of the rotors 207, 208. While the term "rotor" typically indicates that the element is configured to rotate with respect to a stator, in some embodiments only some of the rotors could be configured to rotate while other rotors could remain stationary. For example, in various embodiments rotor 207 could be configured to rotate while rotor 208 could be configured to remain stationary or vice versa. In certain embodiments both rotors 207, 208 could be configured to rotate.

In various embodiments, and described further below, the alternator 204 is modular where the alternator comprises one or more primary alternator modules and optionally one or more auxiliary modules. For example, depicted in FIG. 2, the alternator is shown including a primary module 251 and an auxiliary module 252. In various embodiments power-generation elements 206 and 207 including the primary stator and the rotor could comprise the primary alternator module 251 with the secondary stator 209 and rotor 208 comprising the auxiliary module 252. However, in certain embodiments, the primary module 251 could comprise rotors 207 and 208 with the primary stator 206 and the auxiliary module 252 could comprise just the stator 209. In such embodiments, the alternator modules are cascaded, stacked, or otherwise arranged axially with one another along the central axis 144. In such embodiments, the modules are arranged such that rotor and stator windings of each respective module face one another to form alternating layer of stator windings and rotor magnets. As a result, in various embodiments the cascaded modules can be utilized to produce greater power outputs and/or multiple power outputs.

In addition, while FIG. 2 depicts generally depicts a primary alternator module and an auxiliary module that have different architectures, in certain embodiments, the primary alternator module and the auxiliary alternator module share the same design. In such embodiments, the primary module and auxiliary module share one or more of the same shape, size, and power capabilities. In some embodiments, the projectile only includes a primary alternator module and does not have any cascaded auxiliary alternator modules.

In operation, when the projectile 100 is fired, the interaction of the strakes 160 with oncoming wind or air causes the collar 156 of the collar assembly 124 to despin relative to the main body portion 104, the nose portion 112, and the control support portion 120. In such embodiments the despin causes a relative rotation of the power-generation components 206, 208. For example, referring to FIGS. 1-2, the strakes 160 of the collar 156 are each canted to cause despin of the collar 156 in a clockwise direction, when viewed from the front of the projectile. In one or more embodiments, when fired, the spin rate of the collar 156 is about 1300 Hz±100 Hz. In various embodiments, when fired, the spin rate of the collar assembly 156 is substantially within the range of 300 Hz-2000 Hz. However, in one or more embodiments the spin rate of the collar assembly 156 and/or the projectile will vary based on the muzzle velocity of the projectile. In various embodiments, and described further below, the spin rate of the collar 156 determines the power output of the alternator 204. For example, a higher spin rate will generally correspond to a greater power output and a lower collar spin rate will correspond to a smaller power output.

Figure 3:
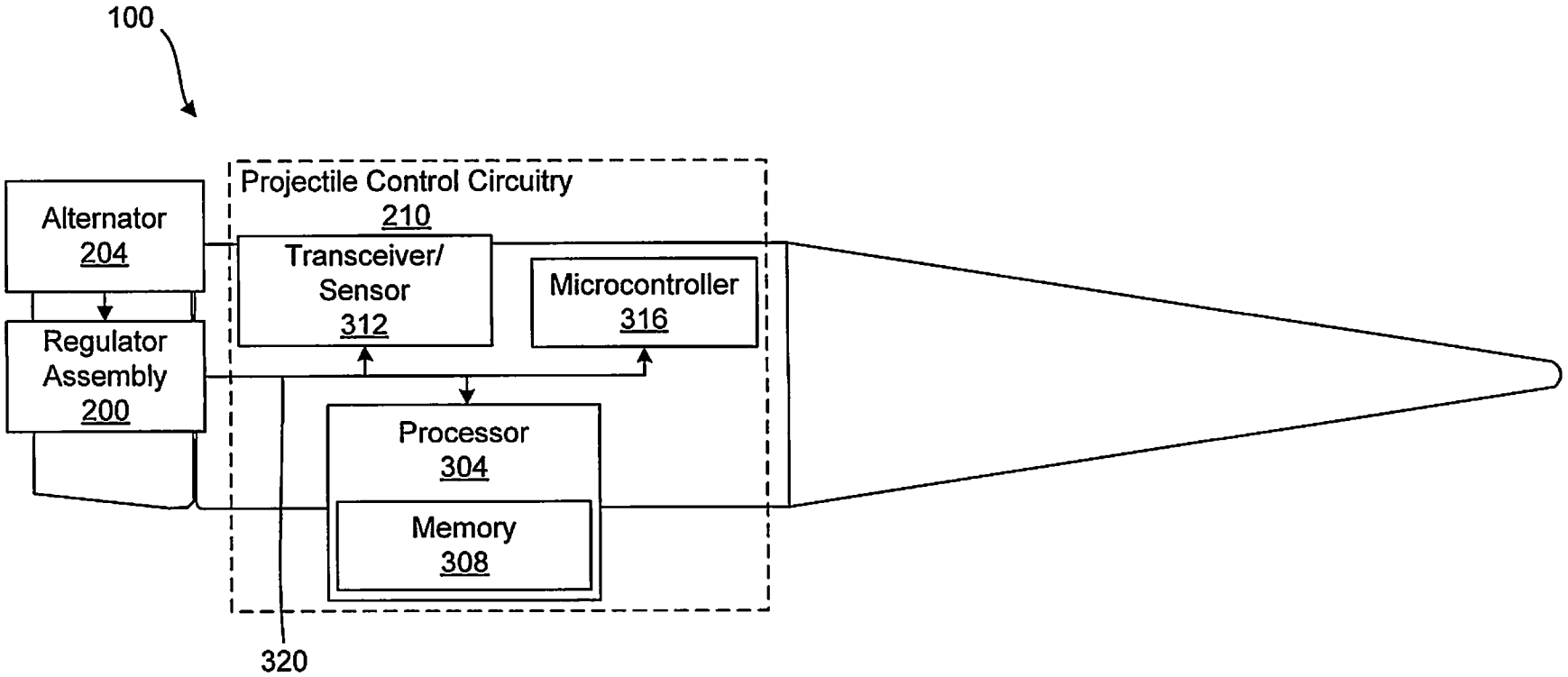
FIG. 3 depicts a system architecture for the powered projectile, according to one or more embodiments of the disclosure.

Referring additionally to FIG. 3, a system architecture for the powered projectile 100 is depicted, according to one or more embodiments of the disclosure. Specifically, FIG. 3 depicts a system architecture for the various electrically powered components of the projectile control circuitry 210 of the projectile 100 with the alternator 204 and regulator assembly 200. In various embodiments the projectile control circuitry 210 includes a processor 304, memory 308, a transceiver 312, and microcontroller 316. In certain embodiments, the projectile control circuitry 210 is connected to a power supply, in the form of the alternator 204, through a regulator assembly 200 via a bus 320 that couples the various system components together.

In various embodiments, processor 304 is a collection of one or more logical cores or units for receiving and executing instructions or programs. For example, in one or more embodiments, processor 304 is configured to receive and execute various routines, programs, objects, components, logic, data structures, and so on to perform particular tasks or implement particular abstract data types. In various embodiments, an FPGA may be used with the processor 304. In various embodiments, an FPGA may be used without an embedded processor 304.

In various embodiments processor 304 includes memory 308. In one or more embodiments, memory 308 is a collection of various computer-readable media in the system architecture. As such, memory 308 can include, but is not limited to volatile media, non-volatile media, removable media, and non-removable media. For example, in one or more embodiments, memory 308 can include random access memory (RAM), cache memory, read only memory (ROM), flash memory, solid state memory, or other suitable type of memory. While FIG. 3 depicts memory 308 as part of the processor 304, in certain embodiments memory 308 could be discrete memory, separated from the processor 304 and connected with the remainder of the projectile control circuitry via bus 320. In certain embodiments, memory 308 includes any storage media that is accessible to the electronic circuitry in the projectile 100, such as remotely located media that is accessible via a network.

In various embodiments transceiver 312 is a communication device for communication and/or for fuzing of the projectile 100. In one or more embodiments, transceiver 312 includes an antenna for sending and receiving RF signals. The antenna may be, for example, a patch antenna, wrap antenna, or other suitable type of antenna. In such embodiments transceiver 312 includes one or more transmitters that can be used to transmit signals at respective frequencies for broadcast from the antenna as RF signals. In addition, in various embodiments transceiver 312 includes one or more receivers for receiving, conditioning, and passing along signals received by the antenna.

In one or more embodiments, the transceiver 312 is configured as a proximity sensor or sensor portion for sensing a target, and collecting target data, including position and/or velocity data about the target. In such embodiments, the transceiver 312 is configured to utilize radio waves, microwaves, laser sensors, thermographic sensors, optical signals, or other suitable means to detect, track, and measure data related to the target. In various embodiments the transceiver 312 includes a returned signal detector that is coupled to the one or more receivers.

In certain embodiments the returned signal detector is configured to analyze returned or reflected signals received by the transceiver 312 to determine a proximity from a surface, object, or person, or other reflector that reflects outgoing RF signals transmitted by the transceiver 312. In various embodiments the detector can then compare previously sent signals to the returned signals in order to determine a time differential between when the signal was sent and then reflected. As such, in one or more embodiments the transceiver may be used to determine the general proximity of the projectile 100 with reference to the ground, objects, surfaces, or the distance of the projectile 100 from a target. In such embodiments, the general proximity of the projectile to various objects can be used to fuze the projectile. For example, in various embodiments the projectile uses the proximity data to make a detonation decision, where the projectile is configured to detonate when positioned within some threshold distance of a detected target. Various proximity fuze systems are further described in U.S. Pat. Nos. 9,709,372; 9,683,814; 8,552,349; 8,757,064; 8,508,404; 7,849,797; 7,548,202; 7,098,841; 6,834,591; 6,389,974; 6,204,801 5,734,389; 5,696,347. These references are hereby incorporated by reference herein in their entirety.

In certain embodiments the transceiver 312 may be included in the projectile as one of an array or a group of sensors for detecting the target, and upon detection, tracking and making various position, velocity, acceleration, and other measurements of the target 128, relative to the respective projectile 100.

In one or more embodiments, transceiver 312 may be utilized for wireless communication. For example, as described above, in certain embodiments the projectile 100 is capable of communication with a targeting controller via a wireless signal to send and receive information. Additionally, in one or more embodiments, the projectile 100 is capable, via transceiver 312, of wireless communication. In such embodiments, the projectiles 100 can be configured to communicate and share various data in flight.

In various embodiments the microcontroller 316 is a controller device possessing a relatively simplified or scaled down logic and memory capabilities, as compared to the processor 304 and memory 308. In such embodiments, the microprocessor is configured to store and process a variety of initial guidance and flight control data. For example, because the microcontroller 316 is configured for low-power operation, the microcontroller 316 will generally include flight control data related to initial flight control operations that occur shortly after the projectile is fired. Such flight control data can include various mission parameters, initial flight control commands, GPS data, and/or other data or instructions.

In various embodiments, once powered on, the microcontroller 316 is configured to simply execute its stored commands/instructions. In certain embodiments, once processor 304 and memory 308 power on, the microcontroller is configured to transmit any necessary data or instructions to the processor 304 and memory 308 as needed for general operation during the main portion of the projectile flight.

In one or more embodiments bus 320 represents one or more of any of suitable type of bus structures for communicatively connecting the electronic circuitry of the projectile 100. As such, in various embodiments internal bus 320 is capable of electrically connecting the alternator 204 and regulator assembly 200 along with connecting the various projectile control circuitry 210. As such, in various embodiments the bus 320 is capable of transmitting instructions and power simultaneously. In such embodiments, the bus 320 includes a memory bus or memory controller, a peripheral bus, and a processor or local bus using any of a variety of bus architectures.

In certain embodiments the various components of the projectile control circuitry 210 represent a special purpose computing system for carrying our various flight control, communications functions, sensing functions, and/or other desired projectile functions. For example, in one or more embodiments, the memory 308 can include a program product having a set (e.g., at least one) of program modules or instructions that are executable by one or more of their respective processor 304 or other logic device such that the program modules in memory 308 configure the respective projectiles 120 to carry out various projectile functions, such as, but not limited to, fuzing, flight control, sensor control, and proximity detection. Program modules may include routines, programs, objects, instructions, logic, data structures, and so on, that perform particular tasks for target intercept, according to one or more of the embodiments described herein.

As described above, the projectile 100 includes a power supply in the form of alternator 204 that is configured to generate power for the projectile 100. For example, in one or more embodiments, when the projectile 100 is fired, the collar 156 is aerodynamically despun relative to the remainder of the projectile 100 causing relative rotation between elements of the alternator 204 and thereby converting the mechanical energy of the collar 156 into electrical energy for operation of the processor 304, memory 308, transceiver 312, and microcontroller 316.

While standard alternators generally control their output voltage within a narrow range, alternator 204 will generate a wide range of output voltages due to the wide range of different spin rates for the collar 156 and the alternator 204 that occur during projectile flight. For example, in certain embodiments the spin rate of the collar 156 after the projectile is fired will be generally within the range of 300 Hz-2000 Hz. As a consequence, in various embodiments the alternator 204 will produce an output during periods of projectile flight that may be less than 15 volts, such as for example when the projectile is initially fired or later in flight as the spin-rate of the projectile and collar decays. Similarly, in certain embodiments the alternator 204 will produce an output that may be 100 volts or even greater, such as for example when the alternator 204 has fully spun-up after the projectile has been fired. Described further below, in various embodiments the regulator assembly 200 is configured to accommodate this wide range of output voltages and regulate these voltages down to specific circuit requirements. For example, the regulator assembly may be configured to regulate the alternator voltage down to a number of specific voltages for the projectile control circuitry 201, such as for example 1.2V, 1.8V, 2.5V, 3.3V, 5V, and 12V.

In certain embodiments, the projectile 100 may additionally include a battery, a capacitor, or any other suitable electric energy storage means. For example, in various embodiments the projectile could include a supercapacitor, ultra-capacitor, or other type of electrochemical capacitor having a relatively high energy density when compared to common capacitors. Such capacitors are well suited for functioning as a powers supply in that they are very small with respect to the energy that they can store, are relatively light in weight and can be charged extremely rapidly without damage. For example, it has been found that a supercapacitor with a value of 0.6 Farad and a voltage rating of 3 Volts can provide power for several minutes, which, in some embodiments would be sufficient for powering on and operation of the microcontroller 316.

In various embodiments, the regulator assembly 200 is a collection of power control components included in the projectile 100 for regulating the input power received from the alternator 204. In such embodiments, the components of the regulator assembly 200 include one or more devices configured to produce a regulated output of downstream voltage/current that stays consistent regardless of the input voltage produced by the alternator 204. As such, in various embodiments the regulator assembly 200 manages the power delivery to the projectile control circuitry 210, such that those components receive sufficient voltage for operation while protecting the components from excess voltages that otherwise could damage or potentially destroy electronic components.

Figure 4A:
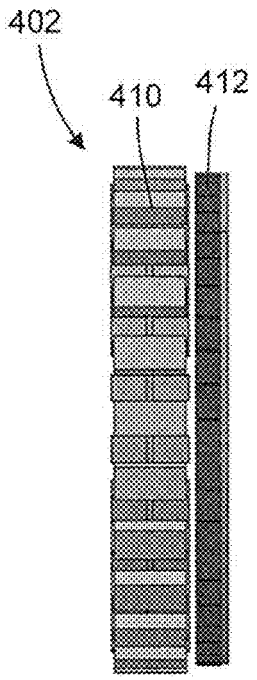
FIG. 4A depicts a side view of a primary alternator module, according to one or more embodiments of the disclosure.
Figure 4B:
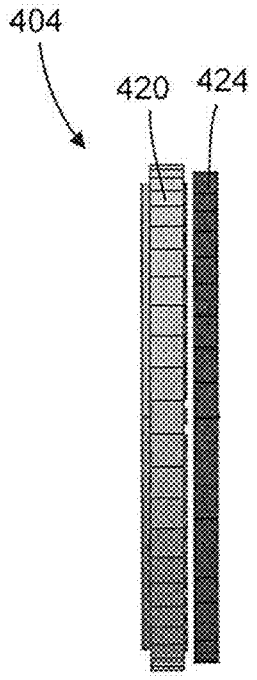
FIG. 4B depicts a side view of an auxiliary alternator module, according to one or more embodiments of the disclosure.
Figure 4C:
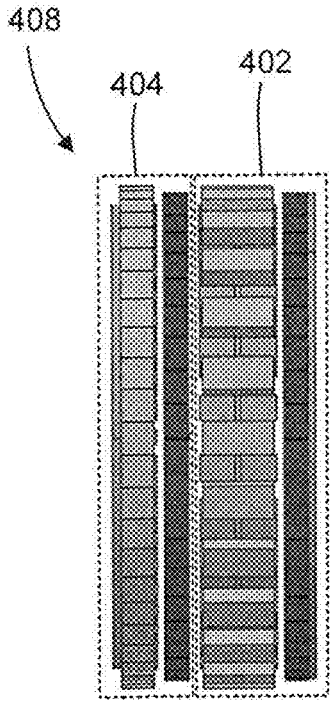
FIG. 4C depicts a side view of a cascaded alternator including the primary module and auxiliary module according to one or more embodiments of the disclosure.
Figure 4E:
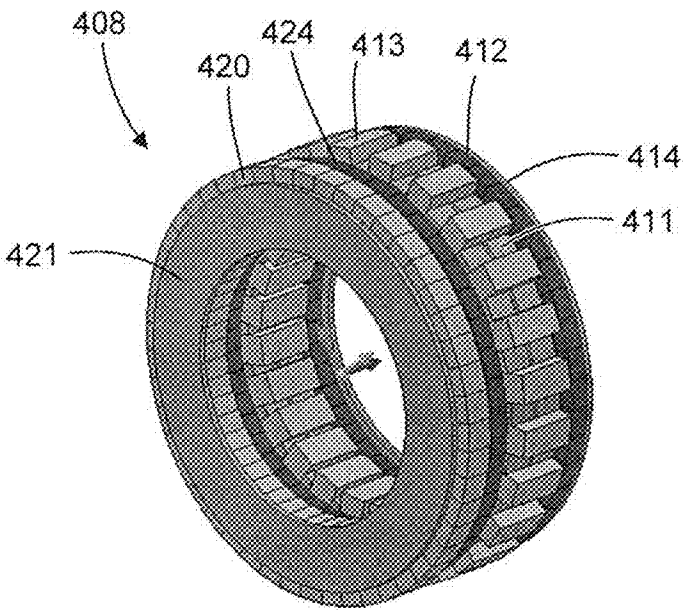
FIGS. 4D-4E depict front and rear perspective views of a cascaded alternator including the primary module and auxiliary module according to one or more embodiments of the disclosure.
Figure 4D:
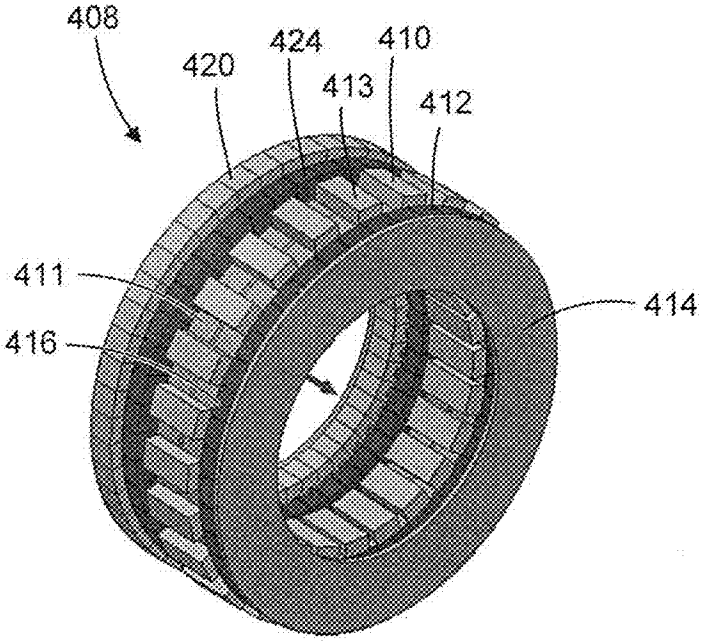

FIGS. 4A-4C depicts a side views of a primary alternator module 402, an auxiliary module 404, and a cascaded alternator 408 including the primary module 402 and auxiliary module 404 according to one or more embodiments of the disclosure. FIGS. 4D-4E depict front and rear perspective views of the cascaded alternator 408 according to one or more embodiments of the disclosure. In various embodiments the primary module 402 includes a primary stator 410 including a yoke structure 411 that supports a plurality of windings 413. In addition, the primary module 402 includes one or more rotors 412 including a yoke structure 414 that supports a plurality of permanent magnets 416 arranged circumferentially about the face of the rotor 412. While the various figures herein depict a stator and rotor with a yoke, yokeless designs for axial flux machines are also contemplated. For example, a yokeless axial flux machine is discussed in WO 2012/015293, incorporated by reference herein for all purposes.

In various embodiments the auxiliary module 404 includes a secondary stator 420 on yoke 421 and a secondary rotor 424. However, in certain embodiments, the primary module 420 could comprise an additional rotor with the primary stator 410 and the auxiliary module 404 could comprise just the secondary stator 420.

In such embodiments, the alternator modules are cascaded, stacked, or otherwise arranged axially with one another along the central axis 144. In such embodiments, the modules are arranged such that rotor and stator windings of each respective module face one another to form alternating layer of stator windings and rotor magnets. As a result, in various embodiments the cascaded modules can be utilized to produce greater power outputs. Axial flux machines take advantage of magnetic field behind the magnet to induced voltage on the adjacent axial flux machine.

In typical devices, such as those utilizing radial flux machines each alternator has a single winding stator. The single winding design dictates the alternator output characteristics within a specific speed range. For example, the single winding design produces a single voltage output that performs according to a voltage curve defined by the alternator's capabilities. However, projectile electronic circuitry has specific voltage limitations based on a maximum and minimum voltage that may not interact well with that voltage curve at many rotation speeds. For example, when the alternator spins below a certain speed, electronics can no longer function or "black out" and therefore impact the mission time. Similarly, when a typical alternator spins at higher speeds electronics can risk damage or black out again as the voltage output from the alternator will begin to exceed the projectile electronics maximum voltage threshold. Some programs struggle with blackout periods during flight, and this is expected to get worse as power demands are increased or projectiles are utilized for long range missions.

In contrast with typical designs, various embodiments described here show multiple back-to-back axial flux machines that can be cascaded to enhance voltage outputs and/or produce multiple voltage outputs that can be switched between while in flight. In various embodiments, some voltage outputs cater to higher speed operation (e.g., by staying within the maximum voltage threshold), while some are catering to the lower speed operation (e.g., by supplying voltage above the minimum threshold at lower speeds). In various embodiments the electronic circuitry can switch between them during the flight as the rotation speed change along the flight.

Figure 10:
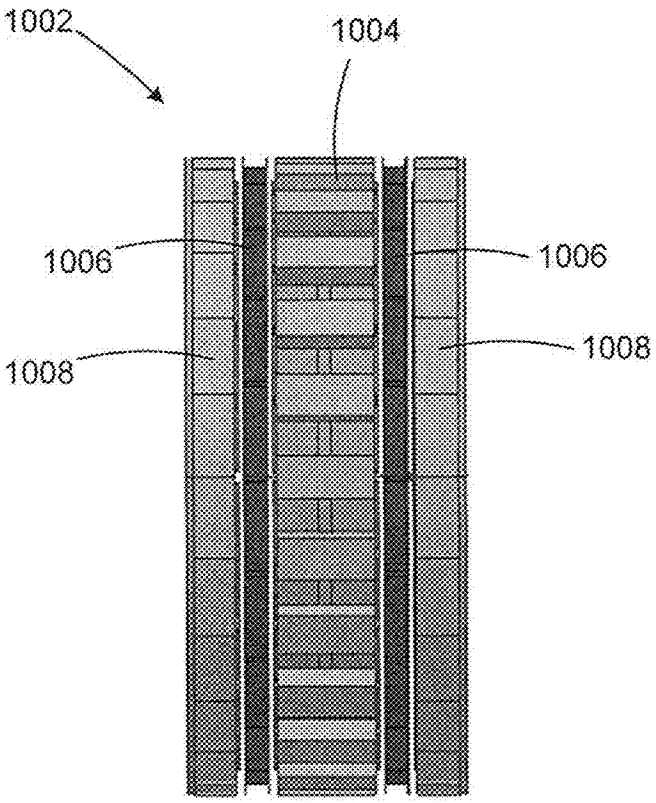
FIGS. 9-11, depict alternative configurations of windings and rotors for an axial alternator, according to one or more embodiments of the disclosure.
Figure 9:
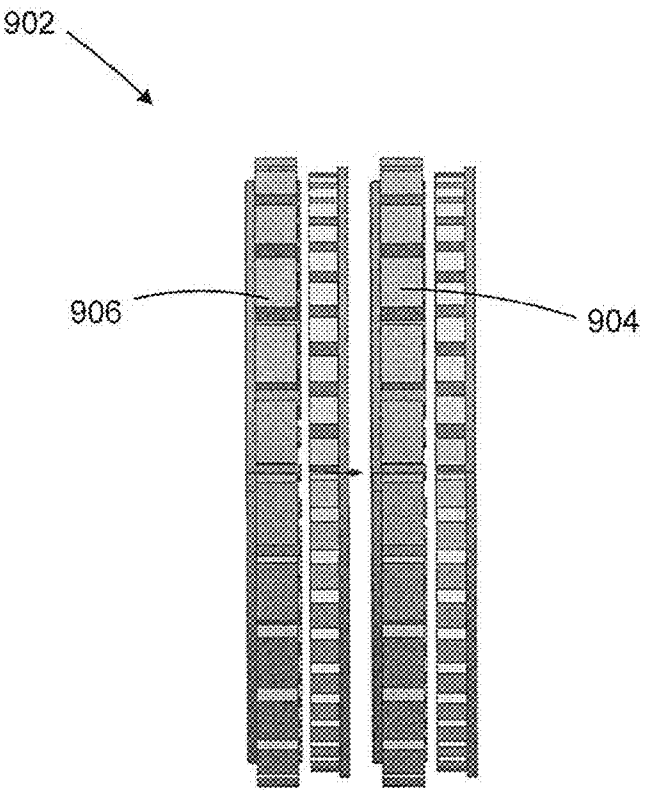
Figure 11:
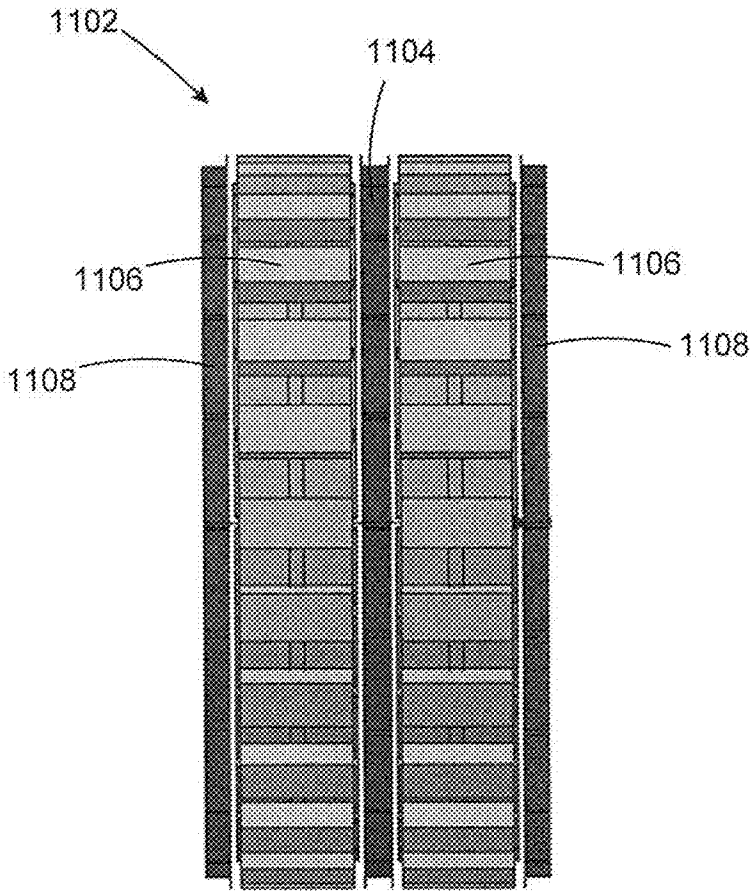

Referring quickly to FIGS. 9-11, alternative configurations of windings and rotors are depicted according to one or more embodiments. Referring to FIG. 9, in various embodiments, an alternator 902 can comprise a primary module 904 and an auxiliary module 906 where the primary and auxiliary module share the same architecture. Referring to FIG. 10, in various embodiments an alternator 1002 can comprise a centrally positioned stator 1004 positioned axially between a pair of rotors 1006. In certain embodiments additional stators 1008 can be positioned on each side of the rotors 1006. Referring to FIG. 11, in various embodiments an alternator 1102 comprises a centrally positioned rotor that is sandwiched between a pair of stators 1104. In various embodiments a pair of additional rotors 1108 can be positioned on each side of the stators 1106.

Figure 5:
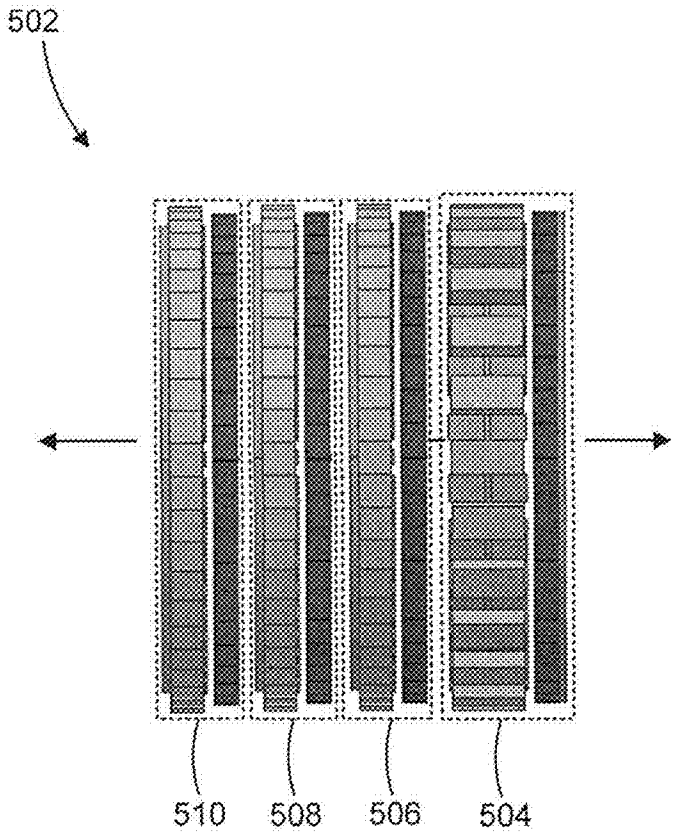
FIG. 5 depicts a side view of a cascaded alternator including the primary module and a plurality of auxiliary modules according to one or more embodiments of the disclosure.

Depicted in FIG. 5 an alternator 502 can be readily scaled up with the addition of additional auxiliary modules. For example, in various embodiments, the alternator can include a primary module 504 along with a plurality of auxiliary modules 506, 508, 510. In such embodiments, enhanced voltage outputs are provided with the interaction of the combined magnetic flux along the central axis. However, in addition, multiple voltage outputs can be produced with the addition of these modules. For example, in various embodiments a voltage output will correspond to a set of windings on each stator. However, in various embodiments even more voltage outputs can be provided via the combination of various outputs in parallel or series. While FIG. 5 depicts the alternator 502 scaled up with the addition of multiple smaller auxiliary modules, it is intended that the term auxiliary module refers to the addition of any extra module beyond the primary module. As such, in various embodiments the "auxiliary modules" could be a number additional stators and rotors that are identical to the stators and rotors that make up the primary module. In certain embodiments this can be referred to as cascading multiple "primary modules". Further, in various embodiments, the windings can be multi-phase windings. For example, in various embodiments the stator is configured with a 3-phase winding. In various embodiments a vast number of phase configurations known in the art. In certain embodiments, multiple sets of windings could be included on a single stator.

Figure 7:
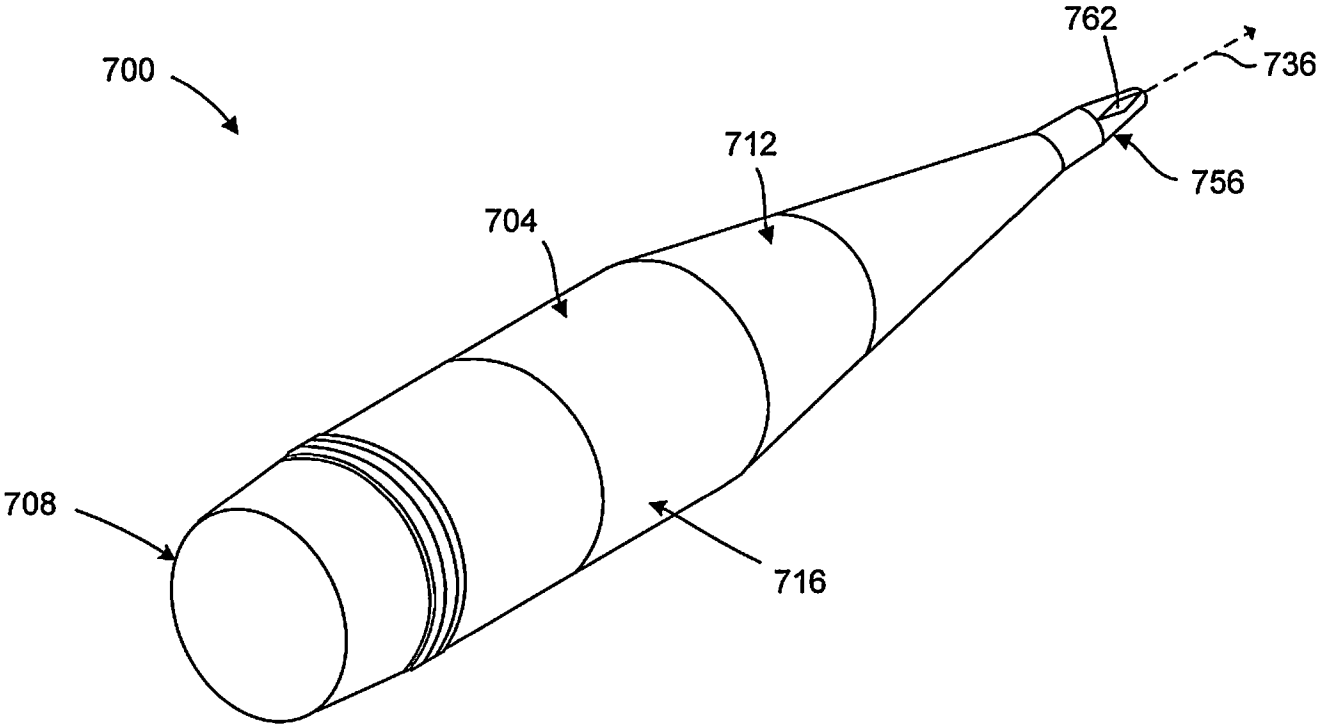
Figure 8:
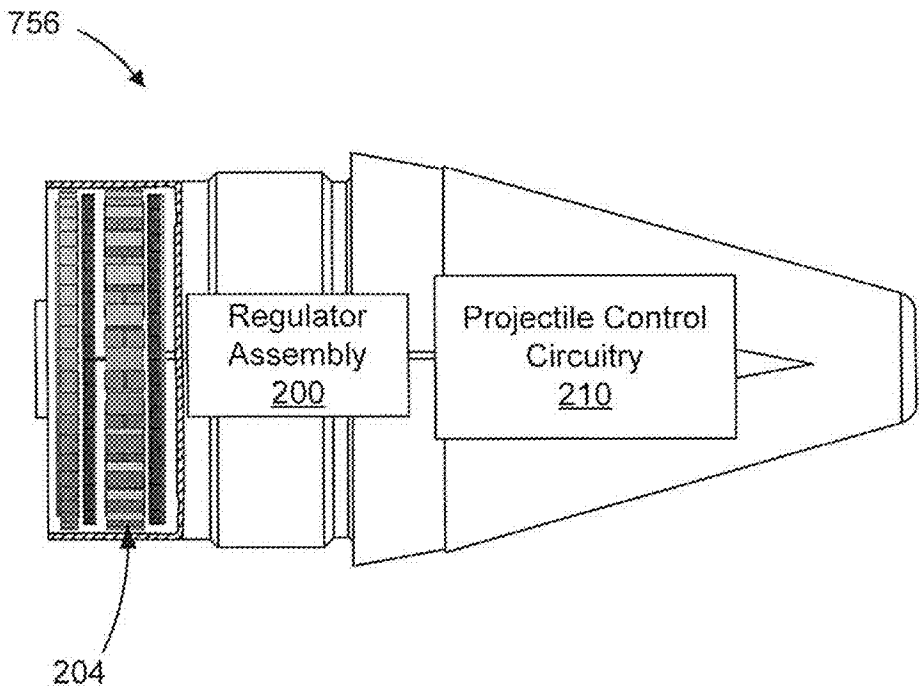

Referring to FIG. 7-8 a large caliber projectile and fuzing portion for a large caliber projectile are depicted, according to one or more embodiments of the disclosure. In FIG. 7, a rear perspective view of a powered projectile 700 including an axial flux machine is depicted, according to one or more embodiments of the disclosure.

In one or more embodiments, the projectile 700 generally includes a main body portion 704, a tail portion 308, and a nose portion 712. In various embodiments a projectile chassis 716 at least partially defines the nose portion 712, the main body portion 704, and the tail portion 708, and extends from the nose portion 712 to the tail portion 708. In one or more embodiments, the main body portion 704 provides a structure for containing and/or supporting various elements of the projectile 700 including payload and operational components. The main body portion 704 has an exterior surface, a forward portion and a rearward portion. A central axis 736 is depicted extending through the projectile 700. In various embodiments the main body portion 704 may have a cylindrical shape or a generally cylindrical shape with one or more tapers.

In various embodiments the nose portion 712 includes a fuzing portion 756. In various embodiments fuzing portion 756 is an attachable module or component configured for handling fuzing and/or various other functions for the projectile 700. For example, in certain embodiments the fuzing portion 756 can include processing circuitry, memory, sensors, and/or various control and/or communications circuitry for guidance of the projectile 700 in-flight. For example, fuzing portion 756 could include various control circuitry such as that discussed in U.S. Pat. No. 6,981,672, which is incorporated by reference herein in its entirety. In various embodiments, fuzing portion 762 includes one or more aerodynamic features 762 configured to spin or despin the fuzing portion 762 in response to an oncoming airstream.

In various embodiments, the projectile 700 includes a driving band. In one or more embodiments, the driving band is a circumferentially extending piece of malleable material that surrounds the projectile 700 for providing a sealing engagement with a rifled barrel upon firing. Described further below, in various embodiment, by providing a sealing engagement with a rifled barrel, the driving band provides for more consistent projectile muzzle velocities by preventing or reducing blow-by of propellent gasses. Additionally, in various embodiments the driving band assists in imparting stabilizing spin on the projectile 700 by engaging the barrel rifling as the projectile travels down a barrel. As such, in various embodiments, the projectile 300 is at least fired as a spin stabilized projectile. However, it is understood that embodiments of the disclosure are applicable to spin stabilized and fin-stabilized projectiles and the projectile 700 of FIG. 7 is not intended to limit the applicability of various embodiments to spin-stabilized projectiles.

In various embodiments, projectile 700 is a large/high caliber spin-stabilized projectile for firing from a rifled barrel or gun. For example, in certain embodiments, projectile 700 is a 155 mm projectile, 105 mm projectile, Navy 5' projectile, or other large caliber shell. The term "large caliber", "high caliber" or the like, as used herein, refers to projectiles having a caliber greater than or equal to 75 mm. However, in certain embodiments the projectile 700 can be a medium or small caliber projectile. As used herein, the term "small caliber" refers to projectiles of 50 caliber or less and the term "medium caliber" refers to projectiles greater than 50 caliber to 75 mm. In addition, the term "spin-stabilized", as used herein, means that the projectile is stabilized by being spun around its longitudinal (forward to rearward) central axis. The spinning mass creates gyroscopic forces that keep the projectile resistant to destabilizing torque in-flight. In addition, as used herein, the term "spin-stabilized" means that the projectile has a gyroscopic stability factor of 1.0 or higher. As such, while some projectiles, such as fin-stabilized projectiles, may have some amount of spin imparted on them during flight, the term "spin-stabilized" applies only to projectiles having a spin-rate such that the quantified gyroscopic stability factor achieves a value of 1.0 or higher.

In one or more embodiments, the a projectile fuzing portion 756 is a modular system removably attachable to a chassis of the projectile 700 in order to configure the projectile for fuzing, communications, sensing, or other functions utilizing an antenna, fuze, and/or other electronics housed within the fuzing portion 756, according to one or more of the embodiments described herein. As such, in one or more embodiments the fuzing portion 356, is configured for insertion in the nose cavity of an artillery shell, mortar, or other suitable projectile. In one or more embodiments the fuzing portion can include various computer circuitry 210, such as a processor and a non-transitory computer readable storage medium including various instructions executable by the processor to cause the processor to operate the system according to the various described embodiments herein. In addition, the fuzing portion 756 can additional include a power supply in the form of an alternator 204 and/or regulator assembly 200, which can be the same or substantially similar to the axial flux machine described herein.

As described above, in use the despinning motion of the module 756 translates the rotational motion of the to cause a corresponding rotational motion of one or more alternator components in the projectile to generate electricity via the relative motion of magnets and windings in an alternator 204 disposed in the module 756. Power generated by the alternator 204 is utilized for powering various projectile control circuitry 210 or other components within the projectile 700.

In addition, while FIGS. 1-2 and FIG. 8 depict the alternator positioned in the fuzing module and rearwardly at the tail of the projectile. It is contemplated that the alternator could be positioned anywhere in the projectile.

In addition to the above, the publications "Analysis of a Dual-Rotor, Toroidal-Winding Axial-Flux Vernier Permanent Magnet Machine" (T. Zou, D. Li, R. Qu, J. Li, and D. Jiang, Institute of Electrical and Electronics Engineers (IEEE), May/June 2017, Vol. 53, No. 3, pp. 1920-1930); and "MechanicalConstructionandAnalysisofanAxialFluxSegmentedArmature Torus Machine" (B. Zhang, Y. Wang, M. Doppelbauer, and M. Gregor, International Conference on Electrical Machines (ICEM), 2-5 Sep. 2014, Berlin, pp. 1293-1299) are both hereby incorporated by reference herein in their entirety.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A projectile with power generation, the projectile having a nose portion, a body portion, a tail portion, and a central axis, the projectile comprising:

a chassis extending axially between the tail portion and the nose portion, the chassis defining an axially extending control support portion;

a collar rotatably mounted to the control support portion, the collar having a circumferentially and axially extending exterior sidewall with a plurality of aerodynamic surfaces thereon for spinning or despinning the collar with respect to the control support portion;

an axial flux power generator configured as a stator arranged axially with a rotor, the rotor connected to the collar such that when the collar rotates with respect control support portion, the rotor also rotates with respect to the control support portion, the stator not rotatable with respect to the control support portion, the stator including a set of windings and the rotor including a plurality of permanent magnets arranged about a face of the rotor that axially confronts the set of windings of the stator with an air gap therebetween; and an assembly of projectile control circuitry operably coupled to receive power from the axial flux power generator, the projectile control circuitry including a processor and memory;

wherein upon relative rotation of the rotor with respect to the stator, magnetic flux from the permanent magnets interacts with the windings of the stators and passes through the air gap between the rotor and stator generating power for the projectile control circuitry.

2. The projectile of claim 1, wherein the projectile is a fin stabilized projectile and the aerodynamic surfaces spin up the collar with respect to the chassis when the projectile is in flight.

3. The projectile of claim 2, wherein the aerodynamic surfaces are part of fins extending radially outward from the collar.

4. The projectile of claim 1, wherein the projectile is a spin stabilized projectile and aerodynamic surfaces despin the collar with respect to the chassis when the projectile is in flight.

5. The projectile of claim 1, wherein the rotor is a first rotor, wherein the projectile further comprises a second rotor with a second set of permanent magnets, the second rotor rotates with the collar, and wherein the stator is positioned axially between the first rotor and the second rotor.

6. The projectile of claim 1, wherein the stator is a first stator having a first plurality of windings, wherein the rotor is a first rotor, wherein the projectile further comprises a second stator with a second plurality of windings, and wherein the first rotor is positioned axially between the first stator and the second stator.

7. The projectile of claim 1, wherein the stator is a first stator having a first plurality of windings, wherein the rotor is a first rotor, wherein the projectile further comprises a second stator with a second plurality of windings and a second rotor with a second set of permanent magnets, the second rotor rotates with the collar, and wherein the first rotor is positioned axially adjacent to the first stator with a first air gap therebetween and the wherein the second rotor is positioned axially adjacent to the second stator with a second air gap therebetween second stator and the second rotor.

8. A large caliber powered projectile having a nose portion, a body portion, a tail portion, and a central axis, the powered projectile comprising:

a chassis extending from the tail portion to the nose portion, the chassis defining a generally cylindrical wall of the body portion;

a fuzing portion mounted or mountable to the nose portion, the fuzing portion including a plurality of aerodynamic surfaces thereon for despinning in response to an oncoming airstream;

the fuzing portion further comprising an axial flux generator including one or more stators arranged axially with one or more rotors, the one or more stators each including a set of windings and the one or more rotors each including a plurality of permanent magnets arranged about the face of the respective one or more rotors, wherein each of the one or more rotors rotate with the aerodynamic surfaces, wherein the one or more rotors and stator windings axially face one another to form alternating axial layers of stator windings and rotor magnets;

wherein upon relative motion of the rotor with respect to the stator, magnetic flux from the plurality of permanent magnets interacts with the set of windings of the stator and passes through an air gap between the one or more rotors and one or more stators.

9. The projectile of claim 8, further comprising projectile control circuitry, the projectile control circuitry including a processor, memory, and a bus coupling the projectile control circuitry together.

10. A projectile axial flux power generator, comprising:

a collar rotatably mounted to an axially extending control support portion of a chassis extending axially between a tail portion and a nose portion of a projectile, wherein the collar comprises a circumferentially and axially extending exterior sidewall defining a plurality of aerodynamic surfaces configured to spin or despin the collar with respect to the control support portion in response to an oncoming airstream;

at least one rotor coupled to the collar and comprising a plurality of permanent magnets arranged about a face of the at least one rotor; and at least one stator comprising a set of windings arranged axially with the at least one rotor to define an air gap therebetween, wherein upon relative motion of the at least one rotor with respect to the at least one stator a magnetic flux from the plurality of permanent magnets passes axially through the air gap and interacts with the set of windings to generate an electrical current therein.

11. The projectile axial flux power generator of claim 10, further comprising an assembly of projectile control circuitry operably coupled to receive power from the axial flux power generator, the projectile control circuitry including a processor and memory;

wherein upon relative rotation of the rotor with respect to the stator, magnetic flux from the permanent magnets interacts with the windings of the stators and passes through the air gap between the rotor and stator generating power for the projectile control circuitry.

12. The projectile axial flux power generator of claim 10, wherein the at least one rotor comprises:

a first rotor coupled to the collar and comprising a first plurality of permanent magnets arranged about a face of the first rotor, wherein the at least one stator is arranged axially with the first rotor to define a first air gap therebetween, and wherein upon relative motion of the first rotor with respect to the at least one stator a first magnetic flux from the first plurality of permanent magnets passes axially through the first air gap and interacts with the set of windings to generate a first electrical current therein; and a second rotor coupled to the collar and comprising a second plurality of permanent magnets arranged about a face of the second rotor, wherein the at least one stator is arranged axially with the second rotor to define a second air gap therebetween, and wherein upon relative motion of the second rotor with respect to the at least one stator a second magnetic flux from the second plurality of permanent magnets passes axially through the second air gap and interacts with the set of windings to generate a second electrical current therein.

13. The projectile axial flux power generator of claim 10, wherein the at least one stator comprises:

a first stator comprising a first set of windings arranged axially with the at least one rotor to define a first air gap therebetween, and wherein upon relative motion of the at least rotor with respect to the first stator a magnetic flux from the plurality of permanent magnets passes axially through the first air gap and interacts with the first set of windings to generate a first electrical current therein; and a second stator comprising a second set of windings arranged axially with the at least one rotor to define a second air gap therebetween, and wherein upon relative motion of the at least rotor with respect to the second stator a magnetic flux from the plurality of permanent magnets passes axially through the second air gap and interacts with the second set of windings to generate a first electrical current therein.

14. The projectile axial flux power generator of claim 10, further comprising a regulator assembly operably coupled to the at least one stator to receive the electrical current, wherein the regulator assembly is configured to output a second electric current having a predetermined voltage.

15. The projectile axial flux power generator of claim 10, wherein the plurality of aerodynamic surfaces comprises at least one of one or more strakes, one or more flaps, and one or more recesses defined by the collar.

16. The projectile axial flux power generator of claim 10, wherein an axial-most extending portion of the plurality of aerodynamic surfaces are within an axial envelop defined an axial-most portion of the chassis.

17. The projectile axial flux power generator of claim 10, wherein the collar is configured to spin at a rate within a range from about 300 Hertz to about 2000 Hertz.

18. The projectile axial flux power generator of claim 10, further comprising:

a processor operably coupled to the at least one stator to receive the electrical current therefrom; and a memory configured to store instructions that, when executed by the processor, cause the processor to control at least one of fuzing, flight control, sensor control, and proximity detection.

19. The projectile axial flux power generator of claim 18, further comprising a transceiver operably coupled to the processor, wherein the transceiver is configured to at least one of determine a proximity from a surface and detect a target.

20. The projectile axial flux power generator of claim 10, further comprising a microcontroller operably coupled to the at least one stator to receive the electrical current therefrom, wherein the microcontroller includes and is configured to execute initial flight instructions comprising at least one of mission parameters, initial flight control commands, and GPS data.

* * * * *